US005954568A

United States Patent [19]

Wirz

[11] Patent Number: 5,954,568

[45] Date of Patent: Sep. 21, 1999

[54] METHOD, TOOL AND DEVICE FOR THE PROFILING OF GRINDING WORMS FOR CONTINUOUS GEAR GRINDING

[75] Inventor: Walter Wirz, Pfaffikon, Switzerland

[73] Assignee: Reishauer AG, Wallisellen, Switzerland

[21] Appl. No.: 08/855,997

[22] Filed: May 14, 1997

[30] Foreign Application Priority Data

May 14, 1996 [DE] Germany ..... 196 19 401

[51] Int. Cl.[6] ..... B24B 1/00

[52] U.S. Cl. ..... 451/47; 451/147; 451/114; 451/260; 451/275; 125/11.01; 125/5; 409/38; 409/50; 409/12; 409/51

[58] Field of Search ..... 451/47, 147, 114, 451/260, 275, 548, 21, 56, 543, 542, 5; 125/11.01, 11.18; 409/38, 50, 11, 17, 12, 51; 407/23, 29

[56] References Cited

U.S. PATENT DOCUMENTS 4,354,328 10/1982 Ainoura ..... 451/542
4,475,319 10/1984 Wirz ..... 451/5
4,545,708 10/1985 Buschhoff et al. ..... 451/147
4,617,761 10/1986 Miyatake et al. ..... 451/219
4,850,155 7/1989 Sulzer ..... 451/47
4,947,590 8/1990 Schapp et al. ..... 451/147
4,950,112 8/1990 Huber ..... 451/147
5,315,790 5/1994 Kish et al. ..... 451/5
5,562,372 10/1996 Baima et al. ..... 409/50

*Primary Examiner*—Robert A. Rose
*Assistant Examiner*—George Nguyen
*Attorney, Agent, or Firm*—Sughrue, Mion, Zinn, Macpeak & Seas, PLLC

[57] ABSTRACT

The profiling tool (10) has a segment (12) of a worm thread. Its active zone (13) is coated with grains of hard material (16) and is crowned in cylinder sections coaxial to the tool axis (26). During profiling, the grinding spindle (2) and the tool (10) rotate synchronously. By appropriate correction of the coupling ratio by means of a CNC control when moving the tool (10) in axial direction of the grinding worm (2), the grinding worm flank (1) can be dressed with any desired topology. The method makes it possible to profile topologically modified grinding worms (2) at the grinding worm (2) rotational speed used for grinding, which was previously not possible.

11 Claims, 3 Drawing Sheets

METHOD, TOOL AND DEVICE FOR THE PROFILING OF GRINDING WORMS FOR CONTINUOUS GEAR GRINDING

BACKGROUND OF THE INVENTION

1. Field of the Invention

The present invention is related to the art of machines and methods for profiling of grinding worms.

2. Description of the Related Art

Continuous generating gear grinding with a cylindrical grinding worm has been the most efficient method for many years for the finishing of the toothing of spur or helical gears. The method recently underwent another rapid increase in performance, especially thanks to the high-precision production, that became possible through NC technology, of very complicated kinematic couplings. Not only the increase in productivity which made ever shorter grinding times possible, but also the flexibility of the method and the relatively low tool costs have resulted in grinding machining of toothing taking place increasingly according to the continuous generating gear grinding method.

As regards flexibility, particularly the possibilities that became known recently of grinding topologically modified tooth flanks should be mentioned. Topologically modified tooth flanks refer to, for example, flanks with a crowning over the width and those with a deviation from the involute form, for example with tip reliefs and/or root reliefs, which may be designed differently, also along the tooth width. Geared wheels designed in such a way are used in high-performance gear boxes with the goal of achieving a longer useful life with, at the same time, lower noise emission in all load ranges. The production of such topological tooth flanks requires an accordingly designed grinding worm as well as coordinated process kinematics during grinding. In doing so, a relatively wide grinding worm is used whose thread (or threads) is/are modified differently over the width of the worm. During the machining of the gear wheel, the grinding worm is brought with different areas of its width into contact with the work piece, depending on the work piece's width section just machined. This movement of the grinding worm along its axis as a function of the movement of the work piece along its axis is referred to as "shifting". Particularly the preparation of a topological grinding worm is thus far unfortunately still a time-consuming operation, because not only the pitch of the worm thread may be any desired function of the rotational angle of the worm, but also the profile shape in each axial section may vary over the length of the entire worm thread. Therefore, the desired topology on the tooth flank to be ground must, to a certain extent, first be applied in distorted form onto the grinding worm flank by profiling or dressing, from where, rectified again through the appropriate process kinematics, it is then transferred onto the tooth flank during the grinding process.

In general, a flank 1 of a grinding worm 2 with any desired topology can only be produced with a punctiform-contacting dressing tool 3 which is held by an accordingly controllable device (see FIG. 1) and which is guided line-by-line over the flanks to be dressed. For this purpose, the dressing tool has a toroid work area 4 at its periphery. The dressing procedure can easily be compared with the milling of a forging die: Each individual surface point of the shape to be produced must be machined individually to the proper dimension with the milling cutter—the die-sinking cutter. In this connection, the cutter path over the surface of the shape to be produced typically runs along parallel tracks situated more or less closely to each other. In case of profiling a topological grinding worm, these parallel tracks are situated helix-like on the flanks of the worm profile, that is, on a virtual cylinder around the grinding worm axis.

If simpler shapes of the topology are needed, it is often sufficient to use a profiling tool 6 that machines the flanks 1 on their entire height at one (FIG. 2). In this case, the work area 4 extends over the flanks and the outer perimeter of the tool 6. Of course, only the pitch and the flank angle over the worm width can then be varied, by accordingly controlling the pivoting angle $\alpha$ and $v_{ax}$ during the profiling. However, in most cases the required topologies can thereby already be produced.

It is clear that with this simplification, the profiling process becomes considerably quicker than when it takes place line-by-line. A considerable disadvantage of all the aforementioned methods is the fact that the grinding worm cannot be profiled at full rotational speed. The profiling tool must always be moved axially to the worm in the worm thread according to the modulus to be dressed and the rotational speed of the worm; this quickly leads to speeds that can no longer be controlled. The profiling rotational speeds for the grinding worms on today's continuous gear grinding machines are on the order of 100 rpm. That is a rotational speed that is 1/20 to 1/40 the speed needed for grinding. Aside from the resulting relatively long dressing times, a geometry of the worm profile produced however precisely by the profiling process becomes imprecise again at full grinding speed because of deformations due to the centrifugal forces. This understandably becomes all the more important the greater the grinding speed or the work rotational speed of the grinding worm is during grinding. The ideal conditions as they exist on most other grinding machines, namely that profiling takes place at the same grinding wheel rotational speed as grinding takes place, thus cannot be achieved on continuous gear grinders, especially according to the previous method.

In DE-PS 31 34 147, a method is described that does not have these restrictions: a profiling worm rotating synchronously with the grinding worm has the same axial pitch as the worm profile to be dressed and is designed at its active perimeter in such a way that it can dress all occurring worm thread profile shapes. Indeed, this dressing method functions at full rotational speed of the grinding worm, but it has the disadvantage that it cannot be used for topological profiling. The pitch cannot be varied either, because it is predetermined by the dressing worm. In addition, the production of such a dressing worm is very costly and for this reason very high tool costs are incurred.

SUMMARY OF THE INVENTION

The present invention is based on the technical problem of indicating a method, a profiling tool and a device that do not have the above disadvantages and allow a topological profiling at full rotational speed of the grinding worm. This technical problem is solved by the combined features of the present invention.

BRIEF DESCRIPTION OF THE DRAWINGS

Below, exemplary embodiments of the invention are explained with the aid of FIGS. 3 through 15. In the figures.

DESCRIPTION OF THE PREFERRED EMBODIMENTS

Figure 1:
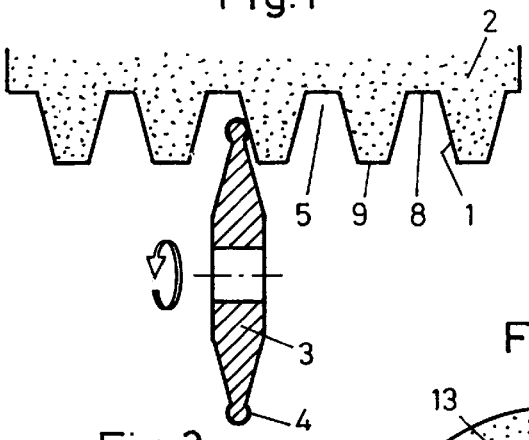
FIGS. 1 and 2 show axial sections of grinding worms and conventional profiling tools.
Figure 2:
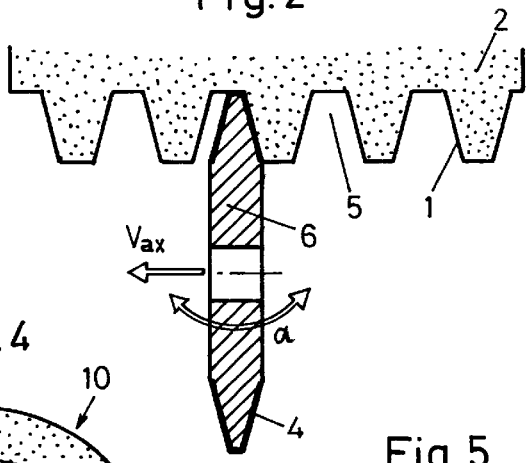
Figure 3:
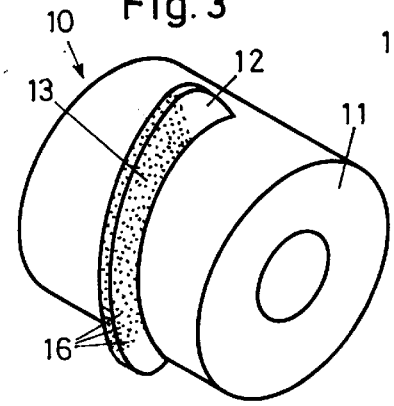
FIGS. 3, 4, 6 and 11 show a first embodiment of a profiling tool according to the present invention.
Figure 4:
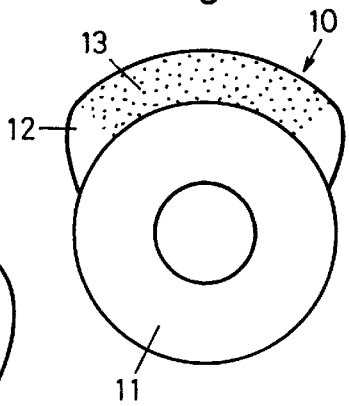
Figure 5:
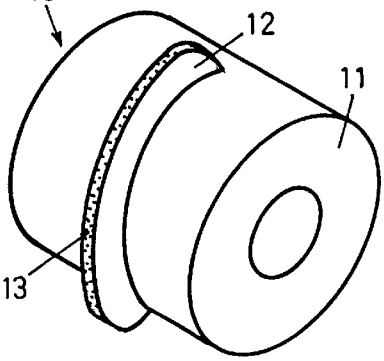
FIG. 5 shows a second embodiment of the present invention.
Figure 6:
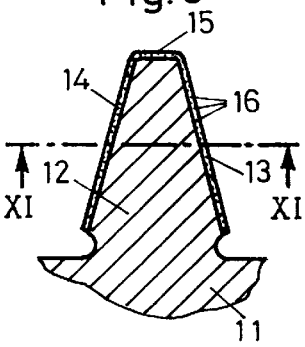

The invention takes advantage of the fact that the variation of the topologically profiled grinding worm pitch is relatively small. For this reason, a profiling tool is proposed that has a limited segment of a worm thread (FIG. 3) or only a line segment from it (FIG. 5). The profiling tool 10 according to FIGS. 3, 4, 6 and 11 consists of a cylindrical basic body 11 of steel, from which the helical worm segment 12 extends. Both its ends taper against the outer cylindrical surface of the body 11. In its middle area 13, the work area, the segment 12 is coated on the flanks 14 and on the cylindrical outer surface 15 with grains of hard material 16, e.g., of diamond or cubical boron nitride. The width of the segment 12 is smaller than the gap between the worm threads 5 to be machined. Observed in an unrolled cylinder section, the work area 13 is crowned on both sides (FIG. 11).

Figure 9:
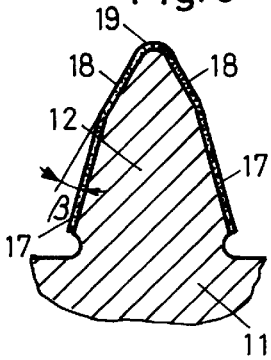
Figure 10:
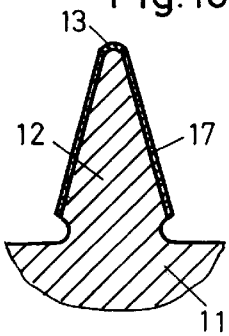
Figure 11:
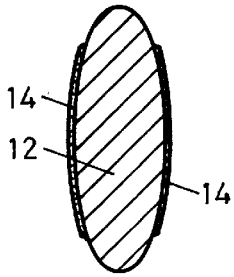
Figure 12:
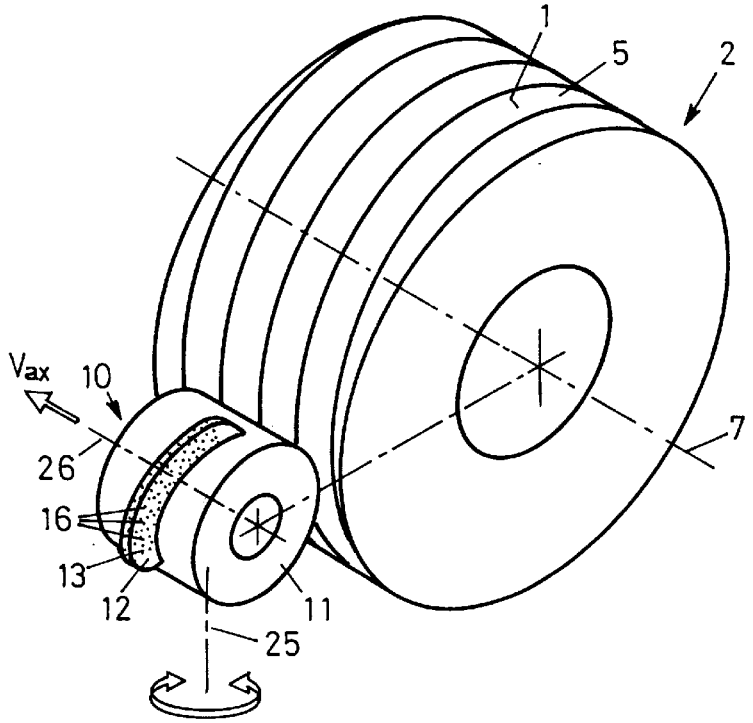
FIGS. 12 and 13 are perspective views of the grinding worm and the profiling tool according to the present invention.

If the profiling tool 10 according to FIGS. 3, 4, 6 and 11 rotates according to the pitch ratio between the profiling worm and the grinding worm synchronously with the grinding worm 2 to be dressed, with each rotation there is a brief contact between the flanks 14, 1 of the profiling tool 10 and of the grinding worm 2. Consequently, a short piece of the grinding worm flank 1 is dressed at this point of contact. By slowly moving the profiling tool 10 running at full rotational speed along the grinding worm pitch, that is, in the direction of the grinding worm axis 7, while at the same time correcting the coupling ratio for synchronism, the worm flank 1 is profiled bit-by-bit over the entire worm width. In doing so, the axial moving speed $v_{ax}$ is completely decoupled from the rotational speed of the grinding and profiling worm. Pitch corrections can be generated via programming of the CNC control by corrections of either the coupling ratio or of the rate of feed $v_{ax}$ during the axial movement (which is geometrically exactly the same). Flank angle changes along the worm thread 5 can be achieved by corresponding rotation of the profiling tool 10 around the vertical axis 25 (FIG. 12) as a function of the axial position with respect to the grinding worm width. In this connection, it is possible to use a punctiform-contact profiling tool (form tool, FIGS. 5 and 7) as well as a profiling segment which covers up the entire profile height (profiling tool, FIGS. 6 and 10). Even combined dressing, in which the worm flank profile to be profiled is dressed zone-by-zone in the profile dressing method and line-by-line in the other sections, is easily possible (FIGS. 9 and 10). The precondition is, as described above, that the pitch variation is not too great. To be able to flawlessly dress the topological grinding worm flank parts with their differing pitch angles, the profiling segment, measured in the pitch course, must be designed slightly crowned (FIG. 11). This crowning is very important; it is a decisive feature of the invention.

Figure 7:
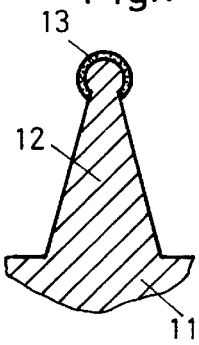
FIGS. 7 through 10 are sectional views, according to FIG. 6, of the second and further embodiments.
Figure 8:
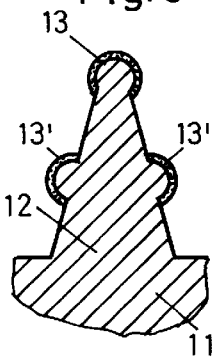

Along its periphery, the profiling tool 10 according to FIGS. 5 and 7 has a helical work area 13 with a circular arc cross-section. It is also crowned in the direction of its pitch course. In the form of execution according to FIG. 8, besides the helical work area 13 according to FIG. 7, on both sides on the flanks 14 of the segment 12, in each case a work area 13' with curved cross-section is arranged approximately halfway up the flanks 14. The radial distance of the work area 13' from the work area 13 corresponds roughly to half the radial height of the grinding worm's 2 flank 1 to be machined. Through corresponding process kinematics, the section 13 and one of the sections 13' can be brought into contact with the grinding worm flank at the same time. In this way, the time used for machining the flank 1 of the grinding worm 2 is roughly cut in half.

In the form of execution according to FIG. 9, the work area 19 extends, in the cross-section of the segment 12, on both sides over two straight sections 17, 18 forming an outer angle β with each other and over a section 19 with a circular arc shape and tangentially adjoining the sections 18. With the sections 17, the majority of the flanks 1 of the grinding worm are profiled, and with the sections 18, a section adjacent to the base 8 of the grinding worm thread 5 is profiled which is intended for the so-called tip relief of the tooth flanks of the gear wheel to be machined. The base 8 of the thread 5 and the tip part 9 including its transitions into the flanks 1 is profiled line-by-line by means of the section 19. The form of execution according to FIG. 10 differs from that according to FIG. 9 in that the sections 18 are missing. If, in the case of the grinding worm, adjacent to the thread base 8 a section is provided for the tip relief, this is also profiled line-by-line by means of the section 13.

In all the described forms of execution, the work areas 13 are crowned, in the direction of the pitch course or in the cylinder sections respectively. In this case, the cylinder sections are the figures which occur if the dressing tool is intersected with a cylinder concentric to the dressing tool axis through the work area.

Figure 13:
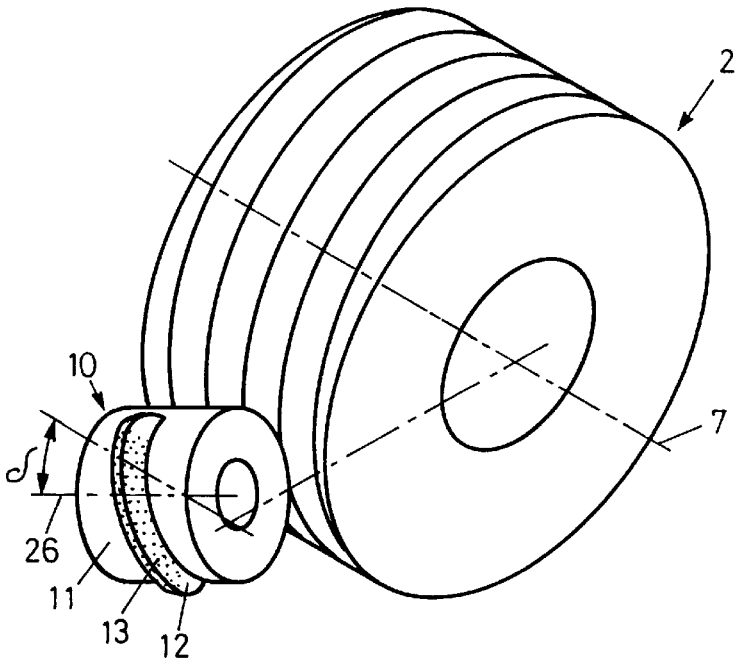

It is easy to see that the conditions when profiling according to the described method become particularly favorable when the pitch angle of the profiling tool flank and of the grinding worm flank are nearly identical and are corresponding. With an essentially parallel arrangement of the axes of the profiling tool 10 and of the grinding worm 2 (FIG. 12) and also approximately the same diameters, that holds particularly true when the two pitch angles are the same size but have different signs (left-handed thread and right-handed thread). With such limit conditions, the relative velocity between the grinding worm flank and the work areas of the profiling tool is slow or nearly zero. For profiling, counter-rotation is often more favorable, which means identical pitch directions for the grinding worm and the dressing tool, however, which consequently results in a high relative velocity. For this case, in order for the flank direction of the profiling tool to approximately concur with that of the grinding worm 2, the two rotational axes 7, 26 must be inclined in relation to each other (angle δ in FIG. 13). The angle of inclination δ of the profiling tool axis 26 in relation to the grinding worm axis 7 corresponds approximately to the sum of the two pitch angles of the profiling tool 10 and the grinding worm 2. So that with such an arrangement, flawless contact conditions are produced between the active surface segment 12 of the profiling tool 10 and the grinding worm flank 1, the crowning should be accordingly designed. Furthermore, the size of the crowning is dependent on the pitch angle variation of the worm thread 5 to be profiled.

Thus, per rotation of the dressing tool 10, a more or less large piece of the grinding worm flank is profiled. If no axial shifting of the tool takes place, the same surface piece of the grinding worm flank 1 is profiled or brushed over with the tool's active zone 13. Through the axial moving speed $v_{ax}$ (FIG. 12), it can now be determined how close to each other the profiled flank pieces should be placed. In this connection, as described above, $v_{ax}$, together with the predetermined values for the topology, influences the coupling ratio of the rotational speeds of the profiling worm 10 to those of the grinding worm 2 in such a way that the active zone 13 of the profiling tool profiles the grinding flank 1 in the desired shape over the entire worm width. By varying $v_{ax}$ on the one hand the fineness of the dressed flank surface and, on the other hand, the profiling speed can be determined. A considerable advantage of this method consists in that the necessary movements for producing the topology take place proportionally to $v_{ax}$ with respect to speed and are independent of the rotational speed of the grinding worm and the profiling worm. That makes dressing possible at any desired grinding worm rotational speed, in particular also at the work rotational speed used subsequently for grinding.

Figure 14:
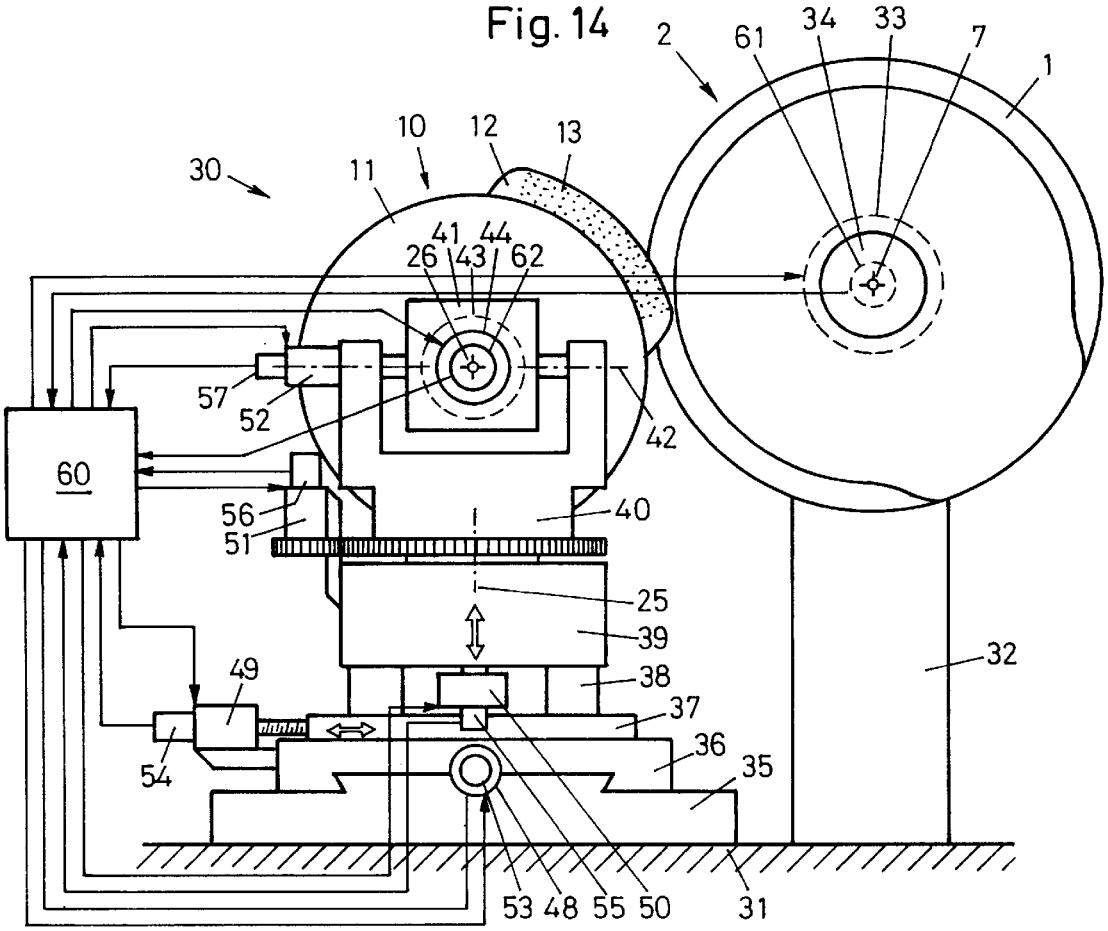
FIG. 14 is a schematic diagram of a profiling device according to the present invention.
Figure 15:
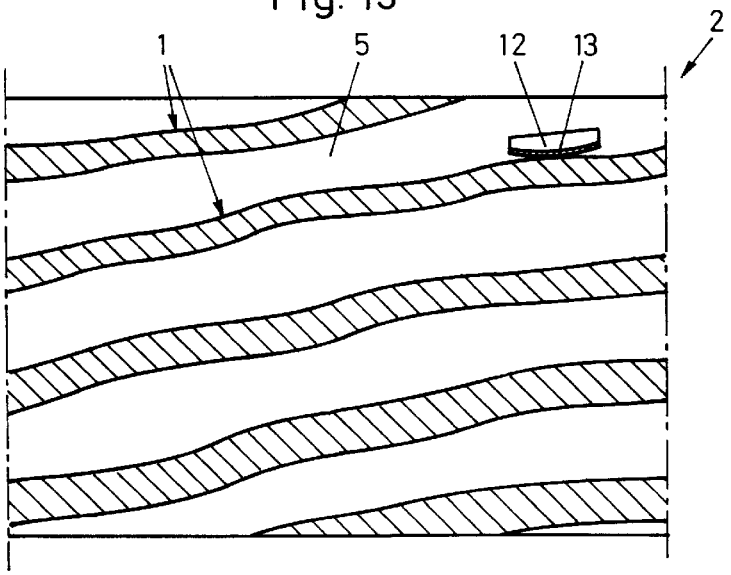
FIG. 15 shows a sectional view of an unrolled cylinder section of a grinding worm during profiling.

FIG. 14 shows a device 30 according to the invention in schematic form. The device 30 may be installed directly in a machine for continuous generating grinding of gear wheels or in a separate dressing machine. On a machine foundation 31, a carrier 32 is attached on which a grinding spindle 34 driven by a motor 33 is lodged rotating. The grinding worm 2 to be profiled is mounted on the spindle 34. The device 30 has a linear guide 35, on which a slide 36 can be shifted parallel to the grinding spindle axis 7. On the slide 36, a second slide 37 can be shifted perpendicular to the axis 7. The slide 37 bears a guide 38 in which a third slide 39 can be shifted perpendicular to the axis 7 and to the direction of shifting of the slide 37. The slide 39 bears a turntable 40 that can be swivelled around the axis 25. On the turntable, a carrier 41 is lodged swivelling around an axis 42 that is perpendicular to the axes 25 and 26. The profiling spindle 43 is lodged rotatable on the carrier 41. It is driven by a motor 44. The slides 36, 37, 39, the turntable 40 and the carrier 41 are each driven by a motor 48, 49, 50, 51, 52. Each of these drives is coupled with a path or angle transmitter 53 through 57. All drives and transmitters are coupled with a programmable CNC controller that can also control the motors 33, 44. These motors 33, 44 are also equipped with rotational angle transmitters 61, 62 for acquisition of the rotational angle of the grinding worm and dressing worm, to control the synchronism.

The illustrated construction is the preferred form of execution. The function of the slides 36, 37, 39 and the turntable 40 can also be interchanged, however. As an alternative, the carrier 32 can also be slidable with the first and/or second slides 36, 37.

The slide 39 (with guide 38, motor 50 and transmitter 55) is not absolutely necessary, insofar as the axis 42 is arranged in such a way that it runs approximately through the middle of the grinding worm.

I claim:

1. A method of profiling a grinding worm for the finishing of gear wheels in continuous generating grinding, the grinding worm having a width and a grinding worm thread extending over several revolutions, the thread having two opposing flanks, wherein the grinding worm is rotatable about a first axis, and wherein a profiling tool is rotatable about a second axis, the profiling tool being provided with a segment of a tool worm thread extending over only a fraction of a revolution, the thread being coated in an active area with grains of hard material, the active area being crowned in cylindrical sections coaxial to the second axis measured in a pitch course of the segment, the method comprising the steps of:

(a) rotating the grinding worm and the tool at a preset ratio of rotational speeds, (b) moving the tool radially with respect to the first axis relative to the grinding worm such that the active area touches one of the flanks in a predetermined angle segment of the tool, (c) moving the tool parallel to the first axis relative to the grinding worm over the entire grinding worm width, and (d) simultaneously correcting the preset ratio of rotational speeds of the grinding worm and the tool as a function of the relative axial movement between the tool and the grinding worm.

2. The method according to claim 1, further comprising the step of:

(e) inclining the second axis relative to the first axis such that the active area of the profiling tool upon contacting the flank of the grinding worm has substantially the same angle to the first axis as the flank.

3. The method according to claim 1, further comprising the step of:

(e) simultaneously with step (d) generating pitch corrections via programming of a CNC control by corrections of one of the preset ratio of rotational speeds and of a rate of feed in the direction of the first axis as a function of displacement parallel to the first axis.

4. The method according to claim 1, further comprising the step of:

(e) simultaneously with step (d) of generating flank angle changes along the grinding worm thread by correspondingly rotating the profiling tool around a third axis which is perpendicular to the first axis as a function of displacement parallel to the first axis.

5. A profiling tool for profiling grinding worms, the tool comprising a basic body having an axis of rotation, a segment of a helical worm thread being formed on the basic body and extending over only a fraction of a revolution, a work area of the segment being coated with grains of hard material, and wherein the work area is crowned in cylindrical sections coaxial to the axis of rotation.

6. The profiling tool according to claim 5, wherein the work area extends at least over two flanks of the segment.

7. The profiling tool according to claim 5, wherein the work area is formed on a crown area of the segment with curved cross-section.

8. The profiling tool according to claim 7, wherein at both flanks of the segment at a distance from the crown area, it has an additional work area with curved cross-section.

9. The profiling tool according to claim 5, wherein the work area has a crown section with curved cross-section and an adjoining flank section on each side.

10. A device for profiling grinding worms for the continuous generating grinding gear-wheels, comprising:

a grinding spindle drivable by a first drive, with a grinding spindle axis and a first angle transmitter;

a first slide that is movable parallel to the grinding spindle axis by means of a second drive, wherein the travel of the first slide is measured by a second transmitter;

a second slide working together with the first slide, movable by a third drive and movable perpendicular to the grinding spindle axis, wherein the travel of the second slide is measured by a third transmitter;

a turntable working together with the two slides and swivelling by means of a fourth drive around a first axis and with a fourth transmitter for measuring the rotational angle of the turntable, wherein the first axis is perpendicular to the grinding spindle axis;

a carrier working together with the turntable and swivelling by means of a fifth drive around a second axis and with a fifth transmitter for measuring the rotational angle of the carrier, wherein the second axis is perpendicular to the first axis;

a profiling spindle lodged rotating around a third axis on the carrier, for mounting a tool, with a sixth transmitter for acquisition of the rotational angle position of the profiling spindle;

a CNC control unit that is connected to all transmitters and at least to the third through the fifth drive and the drives for the grinding and profiling spindles and controls in programmed manner the movement of the third, fourth and fifth drives as a function of the measured values of the second transmitter as well as synchronism of the grinding spindle and the profiling spindle.

11. The device according to claim 10, wherein with the first and second slides a third slide, slidable by means of a seventh drive perpendicular to the moving direction of these slides, works together with a seventh transmitter, wherein the seventh drive and the seventh transmitter are also connected with the control unit.

* * * * *